US006543887B2

(12) United States Patent
Chang et al.

(10) Patent No.: US 6,543,887 B2
(45) Date of Patent: Apr. 8, 2003

(54) INKJET PRINT HEAD

(75) Inventors: Charles C. Chang, Hsinchu (TW); Jhih-Ping Lu, Hsinchu Hsien (TW); Shyh-Haur Su, Hsinchu (TW); Yuan-Liang Lan, Hsinchu Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/004,639

(22) Filed: Dec. 4, 2001

(65) Prior Publication Data

US 2003/0030708 A1 Feb. 13, 2003

(30) Foreign Application Priority Data

Aug. 13, 2001 (TW) ..... 90119737 A

(51) Int. Cl.[7] ..... B21J 2/175
(52) U.S. Cl. ..... 347/87; 347/50
(58) Field of Search ..... 347/85, 86, 87, 347/49, 50, 63, 65, 66

(56) References Cited

U.S. PATENT DOCUMENTS 4,827,294 A * 5/1989 Hanson ..... 347/50
6,039,439 A * 3/2000 Komplin et al. ..... 347/65
6,068,367 A * 5/2000 Fabbri ..... 347/49
6,109,719 A * 8/2000 Cornell ..... 347/14
6,133,926 A * 10/2000 Kawai et al. ..... 347/63
6,227,651 B1 * 5/2001 Watts et al. ..... 347/50

* cited by examiner

*Primary Examiner*—Anh T. N. Vo
(74) *Attorney, Agent, or Firm*—J.C. Patents

(57) ABSTRACT

A common print head module that can accommodate either a single-color or multi-color inkjet print head comprises an ink cartridge having an ink output, and an inkjet chip arranged over the ink output. The ink cartridge internally includes ink channels that terminate through a surface of the ink output, wherein two adjacent ink channels are spaced apart by a channel wall. The channel wall has a top surface lower than the surface of the ink output where the ink channels terminate. The ink channels communicate with ink slots of the inkjet chip. When accommodating a single-color print head, the ink flows out through the ink channels over the channel wall. When accommodating a multi-color print head, the ink slots of the inkjet chip have slot walls that are sealed with the channel walls such that inks of different colors can be separately ejected through the ink slots.

13 Claims, 8 Drawing Sheets

INKJET PRINT HEAD

CROSS-REFERENCE TO RELATED APPLICATION

This application claims the priority benefit of Taiwan application serial no. 90119737, filed Aug. 13, 2001.

BACKGROUND OF THE INVENTION

1. Field of the Invention

The invention relates to a common inkjet print head module that can accommodate either a single-color or multi-color inkjet print head.

2. Description of the Related Art

Principal technologies for printer presently comprise inkjet printer and laser printer. Because of its low price and high quality performance, inkjet printer occupies a substantial part in the market of printers. A principal component of the inkjet printer is the print head that enables the ejection of the ink on the sheet of paper to be printed.

The print head conventionally operates in two fashions for ejecting the ink on the sheet of paper to be printed, those are the piezo-electrical fashion or the thermal bubble fashion. More particularly, thermal bubble technique typically uses heating elements that heat the ink and create vapor bubbles to eject the ink from the print head. With respect to high-resolution inkjet print heads, single-color print heads and multi-color print heads are generally differently designed. To improve the general resolution and speed of the printing, the prior art uses a high-resolution (usually 600 dpi) black print head combined with a low-resolution (usually 300 dpi) multi-color print head within the printer. Inkjet print head structure conventionally includes an ink cartridge and an inkjet chip arranged over the ink cartridge, and the design of these print head components are conventionally different depending on whether the print head is either a black or multi-color print head. With respect to the black inkjet print head, the inkjet chip is provided with, for example, a single ink slot through which black ink is ejected. In turn, in the multi-color print head, the inkjet chip is typically provided with three ink slots through which are ejected three-different-colors inks. The ink cartridge is differently designed to accommodate each of the above specific inkjet chips depending on whether both the ink cartridge and the inkjet chip form a black print head or a multi-color print head.

Because the traditional printer technology necessitates different designs of the print head, the manufacture cost and manufacture time are therefore increased, and a same product quality is hardly ensured for the differently-designed print heads.

SUMMARY OF THE INVENTION

An aspect of the present invention is therefore to provide a common module design for inkjet print head that can accommodate either a single-color or multi-color print head, and reduce thereby the manufacture cost.

To attain the foregoing and other objectives, the present invention provides a common inkjet print head module suitable for use within either a single-color or multi-color inkjet print head, wherein the common module comprises an ink cartridge and an inkjet chip. The ink cartridge has a cartridge body, and a cartridge ink output region located over the cartridge body, wherein the ink output region has an ink output. The cartridge body internally includes a plurality of ink channels that externally terminate through a surface of the ink output, wherein two adjacent ink channels are spaced apart from each other by a channel wall. The channel wall has a top surface that is approximately lower than the surface of the ink output through which the ink channels terminate and are exposed. A plurality of inks held in the ink cartridge can therefore flow out of the ink cartridge through the ink channels of the ink output. Furthermore, the inkjet chip is arranged over the ink output. When accommodating a single-color print head, the inkjet chip comprises a plurality of heating elements that define at least a first heating region, wherein a first ink supplier slot is arranged in the first heating region. When accommodating a multi-color inkjet print head, the heating elements, located in the same first heating region, define at least two second heating regions. In each of the second heating regions is arranged at least a second ink supplier slot, wherein two adjacent second ink supplier slots are spaced apart from each other by a slot wall.

When the above common inkjet print head module accommodates a single-color inkjet print head, the ink channels communicate with the first ink supplier slot, such that the single-color ink can flow through the ink channels and over the top surface thereof to the above-located first ink supplier slot. By heating, the ink can be therefore ejected from the first heating region onto a sheet of paper to be printed.

When the above common inkjet print head module accommodates a multi-color inkjet print head, the inkjet chip is arranged over the ink output such that each channel wall is located below one slot wall. Therefore, each of the ink channels communicates with one second ink supplier slot. Because the top surface of the channel wall is located lower than the surface through which the ink channels are exposed, a gap is created between the slot wall and the channel wall. This gap is sealed to isolate the two adjacent ink channels and ink supplier slots such that inks of different colors can be held therein.

The above common inkjet print head module can further include a tape automatic bonding and a nozzle plate, wherein the tape automatic bonding is electrically connected to the inkjet chip and the nozzle plate is arranged over the inkjet chip.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
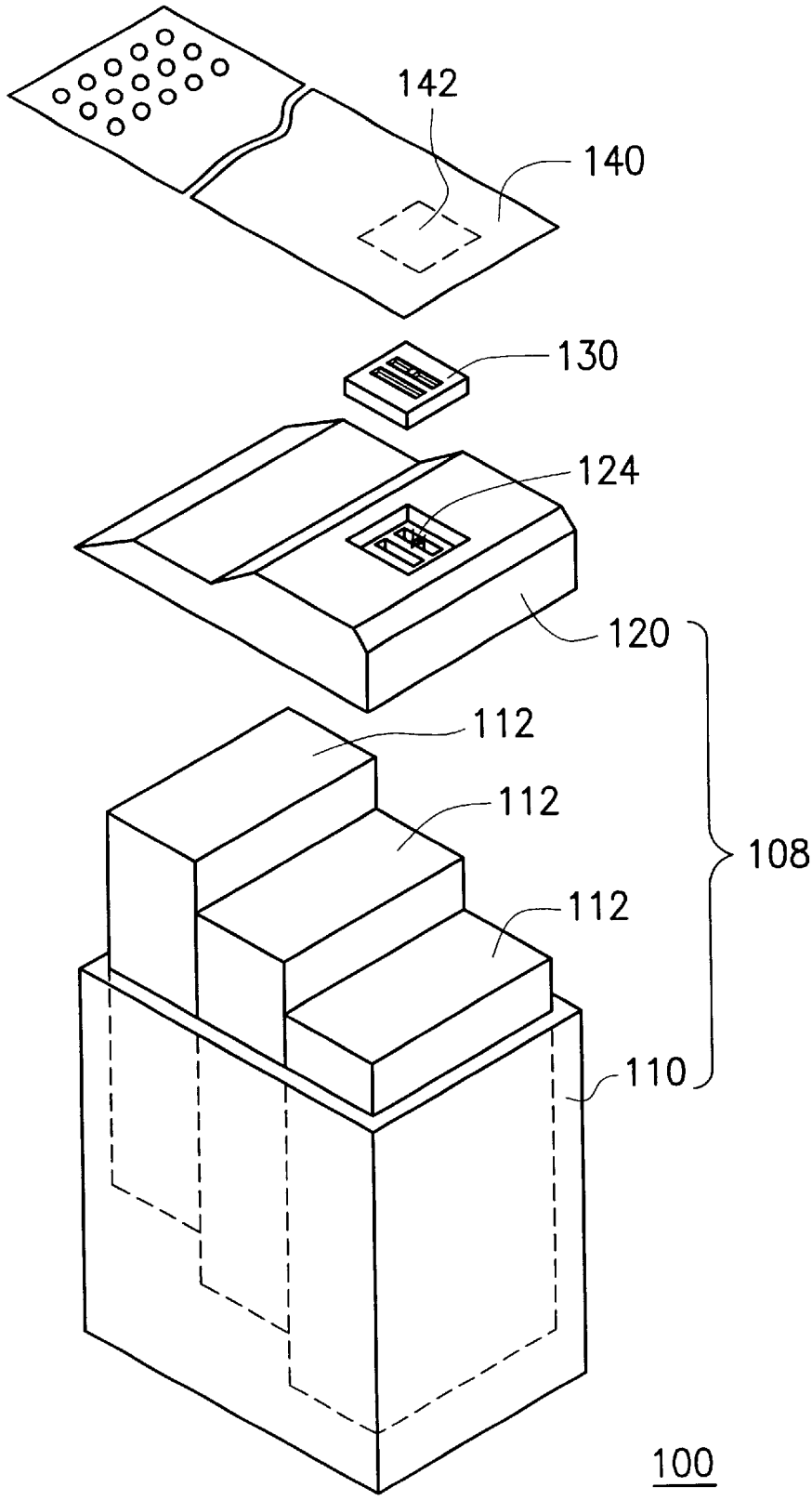
FIG. 1 is an exploded view schematically illustrating different component parts of an inkjet print head according to the present invention.

The following detailed description of the embodiments and examples of the present invention with reference to the accompanying drawings is only illustrative and not limiting. Wherever possible in the following description illustrated by the accompanying drawings, like reference numerals will refer to like elements and parts unless otherwise described.

Figure 2:
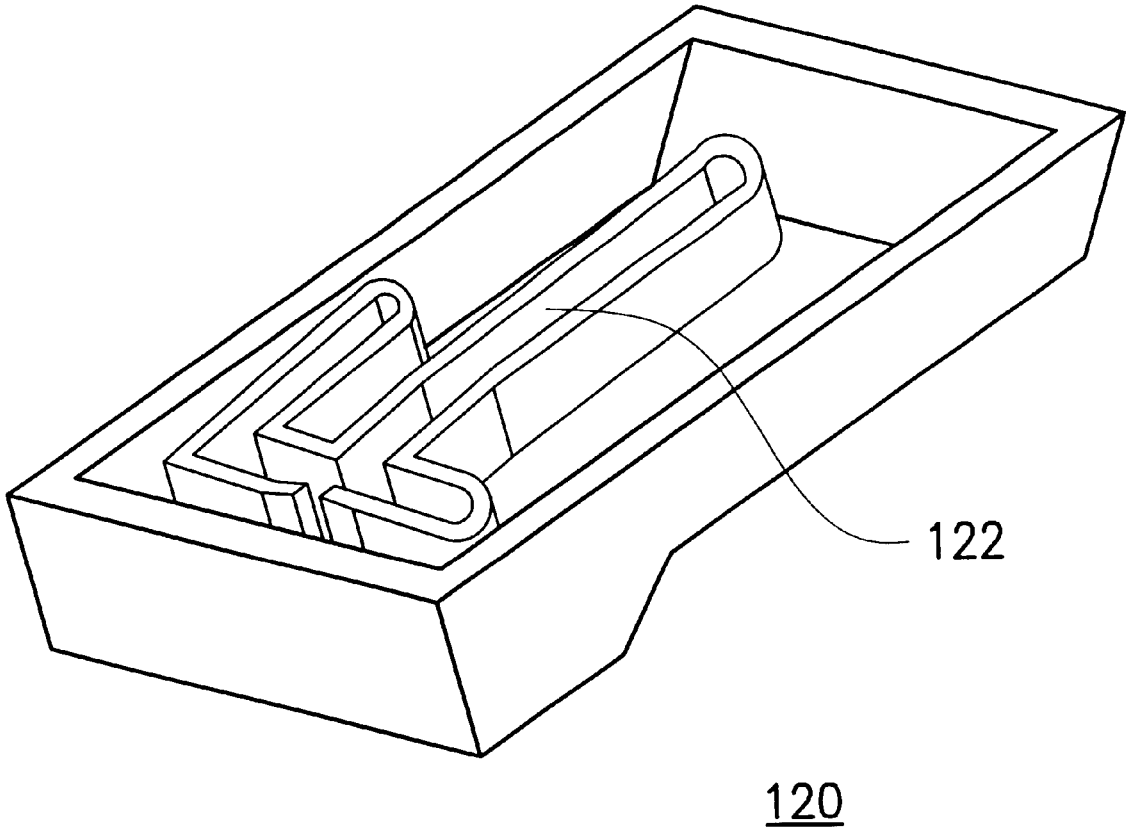
FIG. 2 is a perspective and opposite view of the cartridge ink output region according to an embodiment of the present invention.

Referring now to FIG. 1, an exploded view schematically shows a common module for inkjet print head according to a first embodiment of the present invention. An inkjet print head 100 at least comprises an inkjet chip 130 and an ink cartridge 108. The ink cartridge 108 has an ink cartridge body 110 and ink output region 120. A plurality of ink locations 112 are arranged within the ink cartridge body 110 to hold a plurality of inks therein, those inks can be, for example, the primary color inks of magenta, cyan, and yellow, or single color inks such as black. The ink output region 120 is arranged over the ink cartridge body 110, and internally includes a plurality of ink gutters 122 (as shown in FIG. 2), wherein the ink gutters 122 respectively correspond and communicate with the ink locations 112. The inks held in the ink locations 112 can thereby flow out through an ink output 124 of the ink output region 120.

The inkjet chip 130, for example a single-color inkjet chip or a multi-color inkjet chip, is arranged over the ink output 124 of the ink output region 120. The inkjet chip 130 is further electrically connected to a TAB (Tape Automatic Bonding) 140 at a bonding location 142 thereof.

Based on the above inkjet print head structure, the common inkjet print head module design of the present invention at least comprises an ink cartridge with a specifically designed ink output and an inkjet chip. The specific design of the ink output and inkjet chip provided by the present invention allows for a common basic structure of the ink cartridge and a common basic structure of the inkjet chip to accommodate either single-color inks or multi-color inks. With the present invention, the ink cartridge is therefore specifically designed such that it can similarly accommodate either a single-color or multi-color print head. The inkjet chip mounted over the ink cartridge then can be simply made to accommodate either the single-color or multi-color print head. It should be apparent that the TAB 140 and a nozzle plate (not shown) arranged over the inkjet chip 130 can be further included in the common inkjet print head module of the present invention.

Figure 3A:
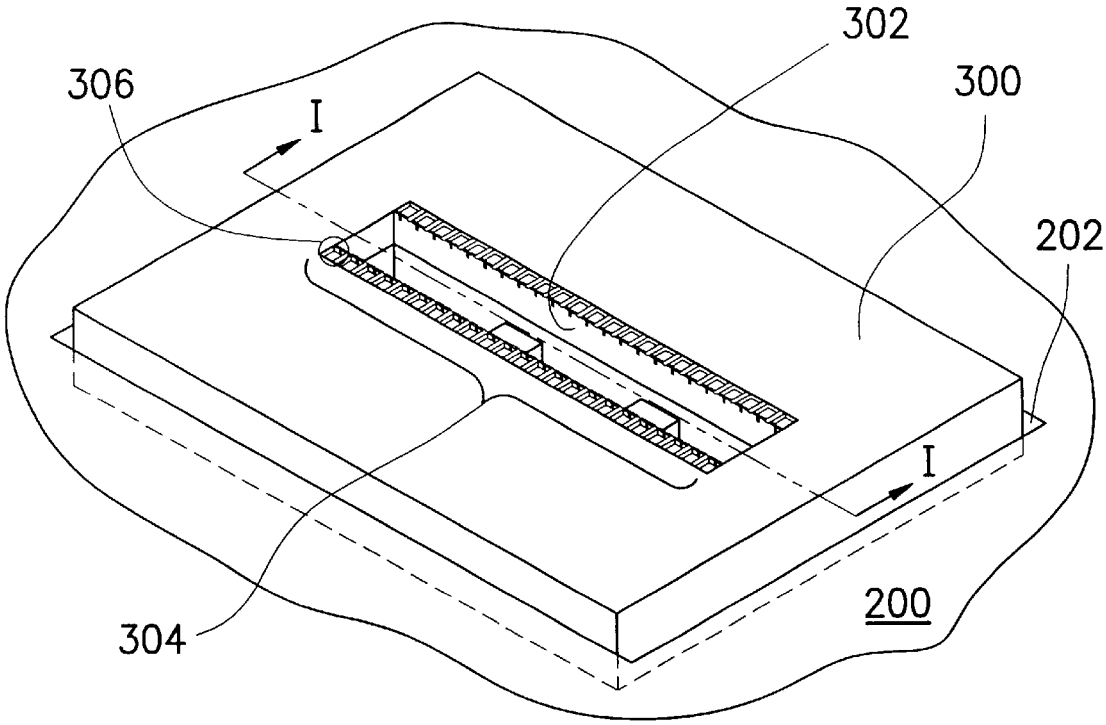
FIG. 3A through FIG. 3E are various views schematically illustrating a common inkjet print head module capable of accommodating either a single-color or multi-color inkjet print head according to a first embodiment of the present invention.

Referring to FIG. 3A, a perspective view schematically illustrates the arrangement of a single-color inkjet chip over an ink output region according to a first embodiment of the present invention. As illustrated in FIG. 3A, a single-color inkjet chip 300 is arranged over an ink output 202 of a cartridge ink output region 200. A plurality of heating elements 306 are disposed on the inkjet chip 300 in shift fashion relatively to each other to form a heating region 304, and an ink supplier slot 302 is arranged in the heating region 304. The heating elements 306 heat the ink to create vapor bubble therein and therefore eject the ink.

Figure 3B:
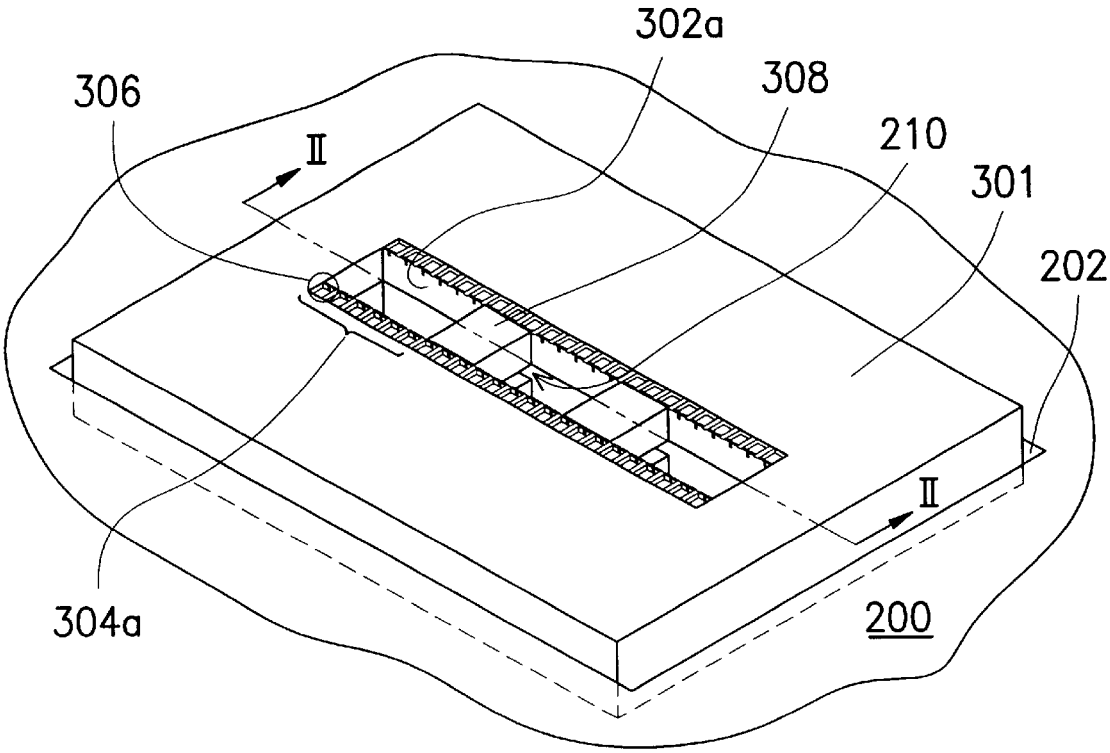

FIG. 3B is a perspective view of a multi-color arranged over a cartridge ink output region according to a first embodiment of the present invention. Referring to FIG. 3A and FIG. 3B, in accordance with the inventive concept of common module design for inkjet print head of the present invention, the basic size and specification of a multi-color inkjet chip 301 are similar to those of the above single-color inkjet chip 300. Furthermore, the heating elements 306 of the multi-color inkjet chip 301 correspond to those of the heating region 304 of the single-color chip 300. However, three heating regions 304*a* are formed on the multi-color inkjet chip 301, each heating regions 304*a* having an ink supplier slot 302*a*, wherein two adjacent ink supplier slots 302*a* are spaced apart by a slot wall 308. In each ink supplier slot 302*a*, the ink is heated by the heating elements 306 to create vapor bubble, which allows the ejection of the ink through the ink supplier slots 302*a*. The heating regions 304*a* can therefore eject three inks of different colors.

The slot walls 308 can be formed by filling method, sand blasting method, laser cutting method, or other adequate methods to form the ink supplier slots 304*a* with the slot wall 308.

Figure 3C:
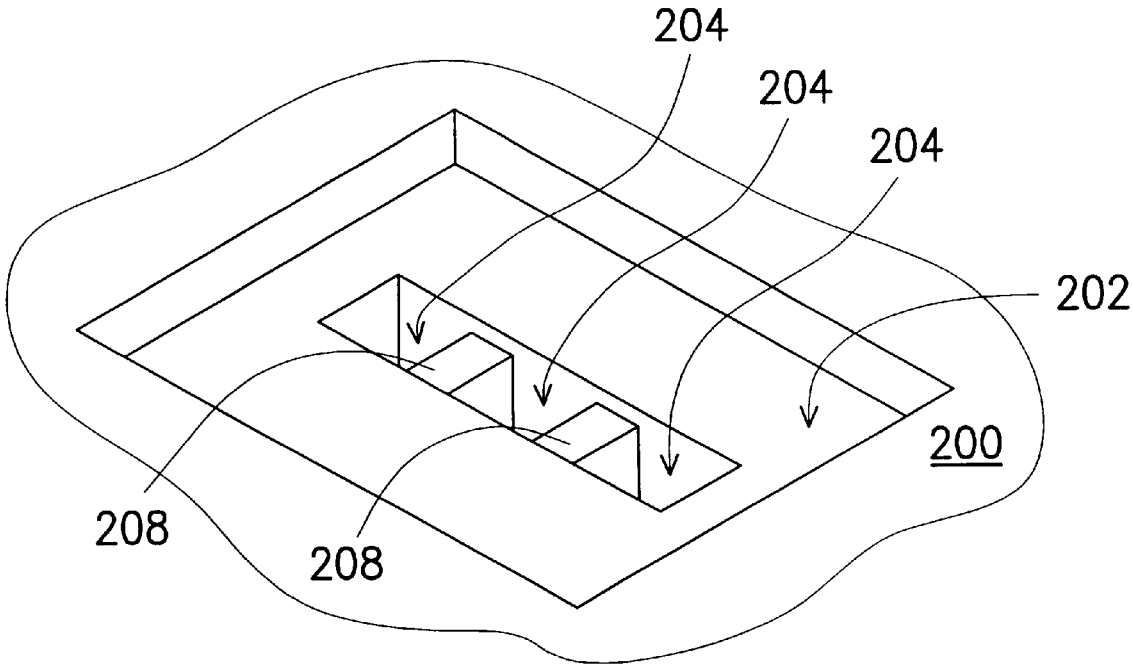

Referring to FIG. 3C, a perspective view schematically illustrates a cartridge ink output region according to the first embodiment of the present invention. The surface of a cartridge ink output region 200 has an ink output 202 with three ink channels 204 located therein. Two adjacent ink channels 204 are spaced apart by a channel wall 208, wherein the location of the channel wall 208 corresponds to that of the slot wall 308 of the multi-color inkjet chip 301. It should be noticed that the top surface of the channel walls 208 is located approximately lower than the surface on which the opening of the ink channels 204 is formed.

Figure 3D:
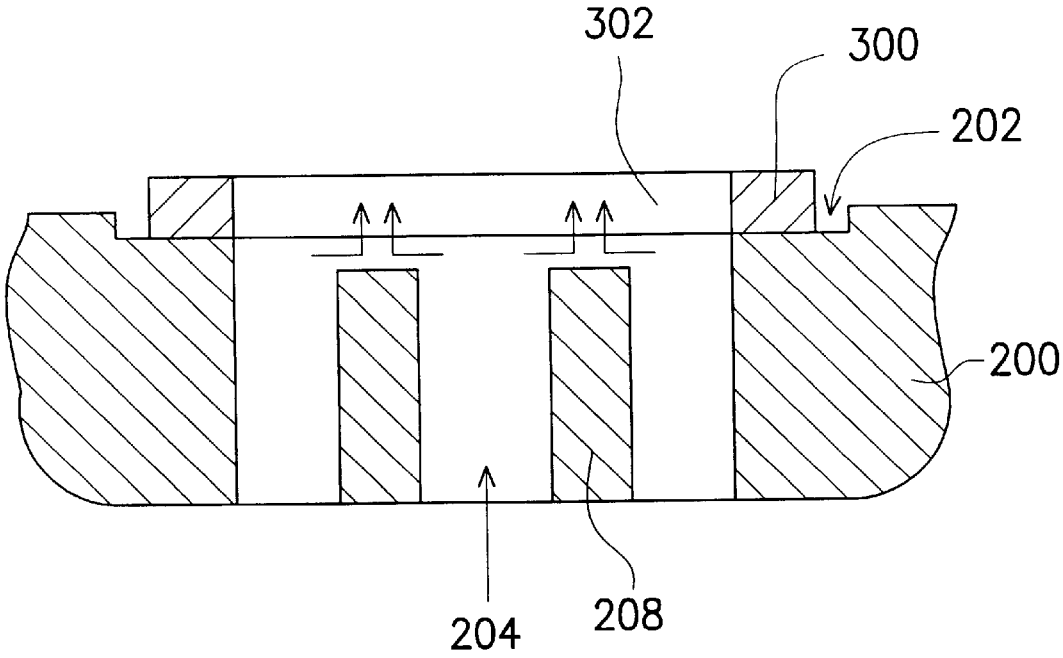

FIG. 3D illustrates a cross-sectional view of FIG. 3A taken along the section I—I. When the single-color inkjet chip 300 is arranged over the ink output 202 of the cartridge ink output region 200, the ink channels 204 all communicate with the single ink supplier slot 302. Because the thickness of the single-color inkjet chip 300 is significantly less than the width of the channel wall 208 top surface, the channel wall 208 top surface is thus leveled approximately lower than the surface of the ink output 202 through which the ink channels 204 terminate. Sufficient spaces are thus arranged above the channel wall 208 top surface to allow the ink to flow over the channel wall 208 top surface to the ink supplier slot 302 there above. The ink can thereby uniformly flow into the heating region 304 and be heated by all the heating elements 306 of the single-color chip 300.

Figure 3E:
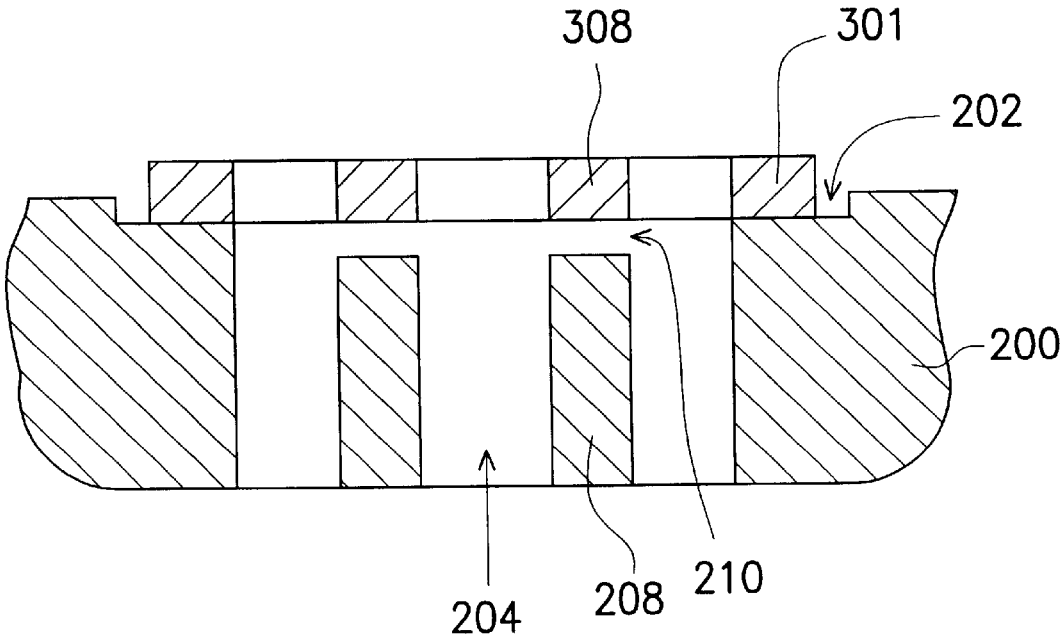

FIG. 3E is a cross-sectional view of FIG. 3B taken along the section II—II. With a inkjet print head module design common to that of the above single-color inkjet chip 300, the multi-color inkjet chip 301 is similarly arranged over the ink output 202, wherein the channel wall 208 locations correspond to the slot wall 308 locations. Because the top surface of the channel walls 208 is lower than the surface where the ink channels 204 terminate, a gap 210 is formed between each slot wall 308 and its corresponding channel wall 208. Because each heating region 304*a* (see FIG. 3B) separately ejects different color inks, the gap 210 must be filled to isolate each ink channel 204 and ink supplier slot 302 containing different color inks. The gap 210 sealing can be achieved by, for example, plastic filling.

Therefore, with the common module design of the present invention, the same basic structure of an ink cartridge and inkjet chip can accommodate either a single-color or multi-color inkjet print head. The design and manufacture costs can therefore favorably reduce.

Figure 4A:
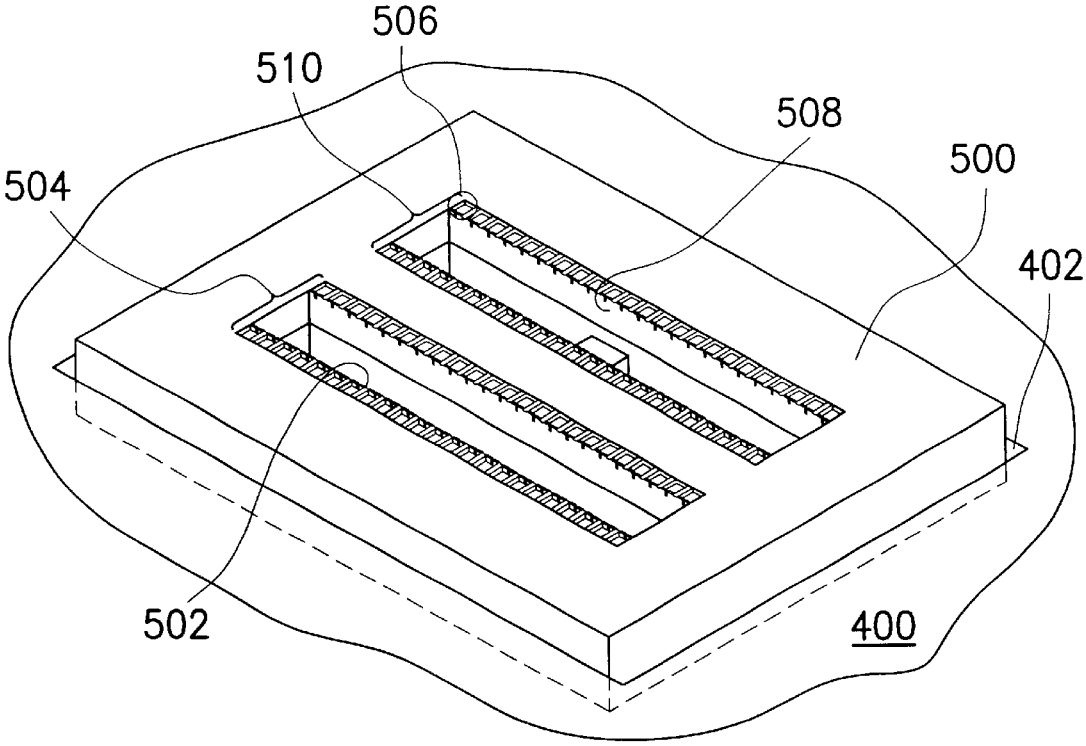
FIG. 4A through FIG. 4C are various views schematically illustrating a common inkjet print head module capable of accommodating either a single-color or multi-color inkjet print head according to a second embodiment of the present invention.
Figure 4B:
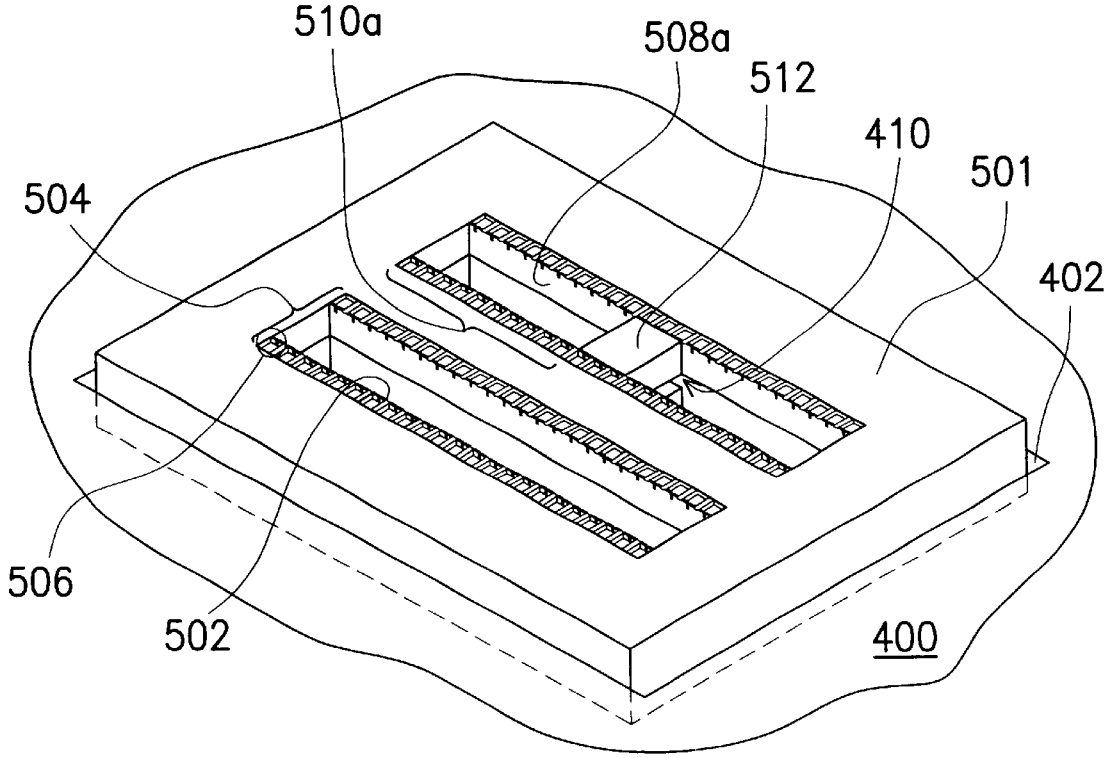
Figure 4C:
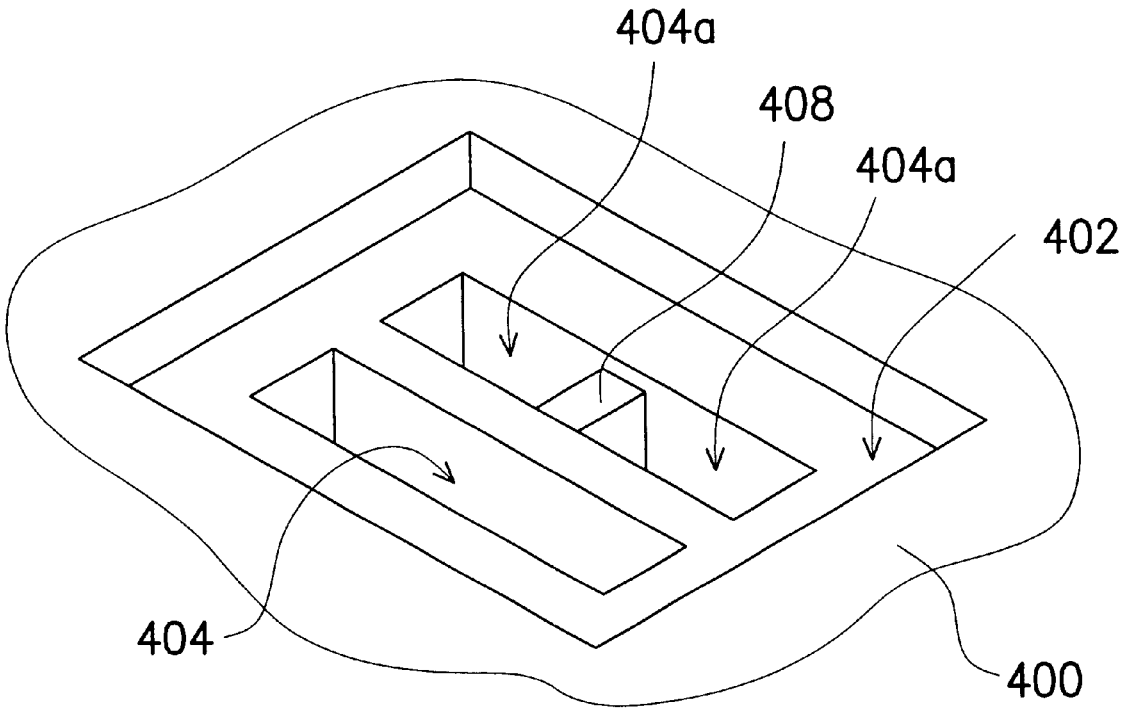

Referring to FIG. 4A through FIG. 4C, various perspective views schematically illustrates a common inkjet print head module design according to a second embodiment of the present invention. The second embodiment differs from the first embodiment in the number of ink supplier slots within the inkjet chip and the corresponding number of ink channels within the ink output of the cartridge ink output region.

With reference to FIG. 4A, a perspective view schematically illustrates a single-color inkjet chip arranged over a cartridge ink output region according to a second embodiment of the present invention. As illustrated in FIG. 4A, a single-color chip 500 is mounted over an ink output 402 of a cartridge ink output region 400. Typically, the inkjet printing resolution is defined by the heating elements 306 of a heating region. Therefore, if one single heating region has, for example, a printing resolution of 300 dpi, two heating regions 504, 510 such as described in the second embodiment of the present invention will consequently have an increased resolution of 600 dpi.

FIG. 4B is a perspective view schematically illustrating a multi-color inkjet chip arranged over a cartridge ink output region according to the second embodiment of the present invention. In accordance with the inventive concept of common inkjet print head module design of the present invention, the size and specification of the multi-color inkjet chip 501 and the size and specification of the single-color inkjet chip 500 are similar. The multi-color inkjet chip 501 differs from the single-color inkjet chip 500 in that a slot wall 512 divides the ink supplier slot of the heating region 510 into two distinctive ink supplier slots 508*a*. Two separate heating regions 510*a* can be thereby defined within the initially heating region 510 of the single-color inkjet chip 500. The heating regions 510*a* can therefore separately eject inks of different colors.

FIG. 4C is a perspective view of a cartridge ink output region according to the second embodiment of the present invention. As illustrated in FIG. 4C, the number and location of ink channels 404, 404*a* within the ink output region 400 is in accordance with those of the ink supplier slots 502, 508*a*, wherein the channel wall 408 location corresponds to the slot wall 512 location. In the case of a multi-color inkjet print head, a multi-color inkjet chip is arranged over the ink output region 400, gap 410 are therefore located between the slot wall 512 and channel wall 408. The reason is that the top surface of the channel wall 512 is down set from the surface of the ink output 402 where the ink channels 404, 404*a* terminate, similarly to the previous embodiment. The gap 410 should be thus sealed to isolate the ink channels 404*a* and ink supplier slots 508*a* from each other. The multi-color inkjet chip 501 can therefore eject a plurality of inks of different colors.

Besides including the advantages brought by the common module design of the invention such as described for the previous embodiment, the common module design of the second embodiment of the present invention additionally provides an increased printing resolution of the inkjet print head.

Figure 5A:
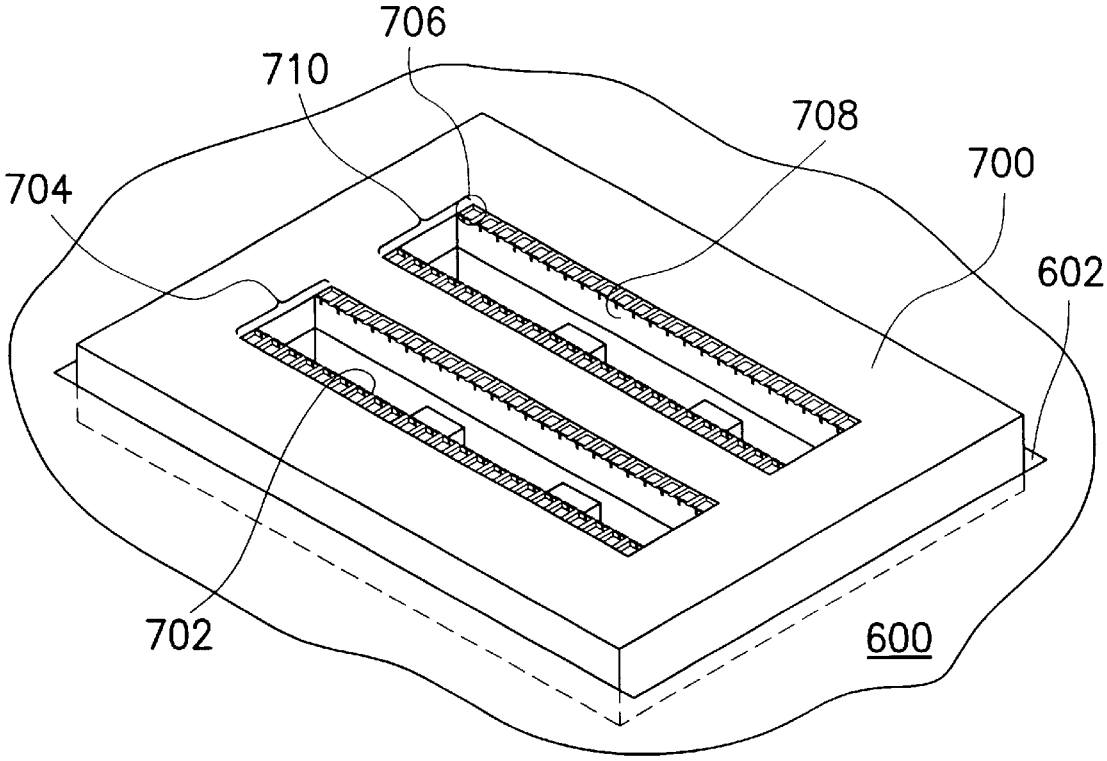
FIG. 5A and FIG. 5B are various views schematically illustrating a common inkjet print head module capable of accommodating either a single-color or multi-color inkjet print head according to a third embodiment of the present invention.
Figure 5B:
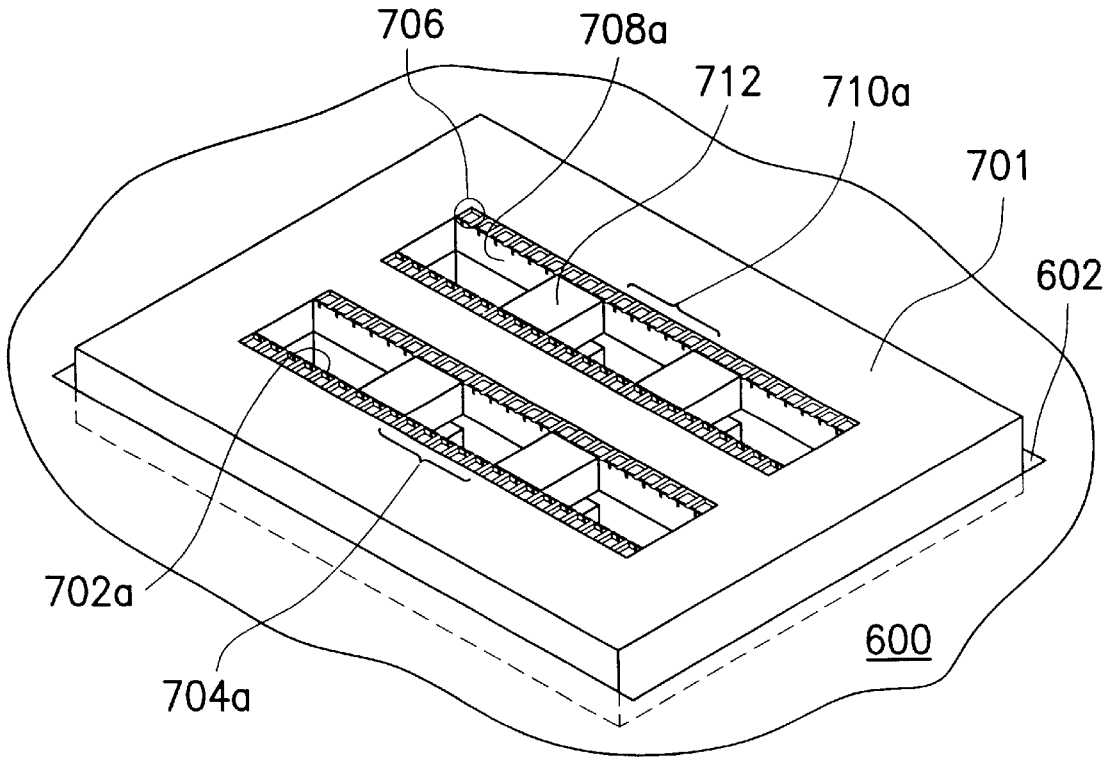

Referring now to FIG. 5A through FIG. 5B, two perspective views schematically illustrate a common inkjet print head module design according to a third embodiment of the present invention. The third embodiment illustrates a variation of the present invention wherein the number of ink supplier slots and the number of ink channels are increased.

With reference to FIG. 5A, a perspective view illustrates a single-color inkjet chip arranged over a cartridge ink output region according to a third embodiment of the present invention. As illustrated in FIG. 5A, a single-color inkjet chip 700 may be arranged over an ink output 602 of a cartridge ink output region 600. The single-color inkjet chip 700 is provided with a plurality of heating regions 704, 710. Each of the heating regions 704, 710 includes a plurality of heating elements 706 arranged in shift fashion relatively to each other to create vapor bubble and eject ink.

Referring to FIG. 5B, a perspective view illustrates a multi-color inkjet chip arranged over a cartridge ink output region according to the third embodiment of the present invention. As illustrated in FIG. 5B, a multi-color inkjet chip 701 may be arranged over the ink output 602 of the cartridge ink output region 600. The heating elements 706 of the multi-color inkjet chip 701 correspond to those of the heating regions 704, 710 of the single-color inkjet chip 700, and form three heating regions 704*a* and three heating regions 710*a*. Each heating region 704*a*, 710*a* respectively has an ink supplier slot 702*a*, 708*a*, wherein each of two adjacent ink supplier slots 702*a* and each of two adjacent ink supplier slots 708*a* are spaced apart by slot walls 712.

The above third embodiment favorably provides a common module design for both single-color inkjet chip and multi-color inkjet chip in which the printing resolution of either the single-color or multi-color inkjet print head can be substantially increased, while the design cost is reduced.

In conclusion, the common inkjet print head module design of the present invention can favorably accommodate either a multi-color inkjet print head or single-color print head. With the present invention, the print head components, including the ink cartridge, TAB, and the nozzle plate are gathered in one independent module that can similarly accommodate either a single-color print head or a multi-color print head. Meanwhile, a common standard inkjet chip can be made to accommodate either the single-color inkjet print head or the multi-color inkjet print head. As a result, the design can be simplified, and both the design and manufacture costs are advantageously reduced. Moreover, the quality can be better controlled for both single-color and multi-color type inkjet print heads. Furthermore, the modular design of the present invention can be implemented for inkjet print heads of various resolutions.

It will be apparent to those skilled in the art that various modifications and variations can be made to the structure of the present invention without departing from the scope or spirit of the invention.

What is claimed is:

1. A common inkjet print head module, suitable for use within a single-color inkjet print head or a multi-color inkjet print head, comprising:

an ink cartridge, the ink cartridge has an ink output region and a cartridge body that can hold a plurality of inks, wherein the ink output region is located over the cartridge body, and an ink output is arranged on the ink output region, the ink output region internally includes a plurality of ink channels that terminate through a surface of the ink output, wherein the ink channels are spaced apart from one another via at least a channel wall, wherein a top surface of the channel wall is lower than the surface of the ink output where the ink channels terminate, and the inks held in the cartridge body can flow out through each of the ink channels; and an inkjet chip, the inkjet chip is arranged over the ink output and comprises a plurality of heating elements thereon, wherein the heating elements are distributed into at least a first heating region in which is located at least an ink supplier slot when the common inkjet print head module is used in the single-color inkjet print head, and wherein the heating elements are distributed into at least two second heating regions in each of which is located at least a second ink supplier slot when the common inkjet print head module is used in the multi-color inkjet print head, the second ink supplier slots being spaced apart from one another by at least a slot wall.

2. The inkjet print head common module of claim 1 used in the single-color inkjet print head, wherein the ink channels of the ink output region all communicate with the first ink supplier slot of the inkjet chip to duct the ink to the first heating region.

3. The inkjet print head common module of claim 2, wherein a single-color ink held in the ink cartridge can flow through the ink channels and over the top surface of the channel wall to the first ink supplier slot located above the channel wall.

4. The inkjet print head common module of claim 1 used within the multi-color inkjet print head, wherein each of the ink channels of the ink output region respectively communicates with one of the second ink supplier slots of the inkjet chip such that inks of different colors can be separately ejected from the second heating regions.

5. The inkjet print head common module of claim 4, wherein the channel wall is located below the slot wall and a gap separates the channel wall and the slot wall.

6. The inkjet print head common module of claim 5, wherein the gap between the channel wall and the slot wall is sealed to isolate the inks held on the two adjacent ink channels and the second ink supplier slots.

7. The inkjet print head common module of claim 6, wherein the gap sealing is performed by filling method.

8. The inkjet print head common module of claim 1, wherein the slot wall is formed by filling method.

9. The inkjet print head common module of claim 1, wherein the slot wall is formed by sand blasting performed to form the second ink supplier slots.

10. The inkjet print head common module of claim 1, wherein the slot wall is formed by laser cutting performed to form the second ink supplier slots.

11. The inkjet print head common module of claim 1, further comprising a tape automatic bonding that is electrically connected to the inkjet chip.

12. The inkjet print head common module of claim 11, further including a nozzle plate that is arranged over the inkjet chip.

13. The inkjet print head common module of claim 1, further including a nozzle plate that is arranged over the inkjet chip.

* * * * *